US008911663B2

(12) United States Patent
Vachon et al.

(10) Patent No.: US 8,911,663 B2
(45) Date of Patent: Dec. 16, 2014

(54) INSULATED IRON-BASE POWDER FOR SOFT MAGNETIC APPLICATIONS

(75) Inventors: Guillem Vachon, Quebec (CA); Claude Gelinas, Montreal (CA)

(73) Assignee: Quebec Metal Powders, Ltd., Quebec (CA)

( * ) Notice: Subject to any disclaimer, the term of this patent is extended or adjusted under 35 U.S.C. 154(b) by 1158 days.

(21) Appl. No.: 12/398,391

(22) Filed: Mar. 5, 2009

(65) Prior Publication Data

US 2010/0224822 A1 Sep. 9, 2010

(51) Int. Cl.

| | |
|---|---|
| ***B22F 1/02*** | (2006.01) |
| ***H01F 1/24*** | (2006.01) |
| ***C22C 33/02*** | (2006.01) |
| ***H01F 1/33*** | (2006.01) |
| ***H01F 41/02*** | (2006.01) |

(52) U.S. Cl.

CPC .. *H01F 1/24* (2013.01); *B22F 1/02* (2013.01); *C22C 33/0228* (2013.01); *H01F 1/33* (2013.01); *H01F 41/0246* (2013.01); *B22F 2998/10* (2013.01)

USPC ..... 419/35; 75/343; 75/255; 419/10; 419/23; 419/36; 419/37; 419/39; 148/513

(58) Field of Classification Search

CPC ..... H01F 1/24; B22F 1/02

USPC ..... 75/254; 419/5, 35

See application file for complete search history.

(56) References Cited

U.S. PATENT DOCUMENTS

| | | | | |
|---|---|---|---|---|
| 2,503,947 | A * | 4/1950 | Haskew | 264/104 |
| 4,092,459 | A | 5/1978 | Deffeyes et al. | |
| 4,165,232 | A | 8/1979 | Jaeckh et al. | |
| 4,218,507 | A | 8/1980 | Deffeyes et al. | |
| 4,295,879 | A | 10/1981 | Steck et al. | |
| 4,344,791 | A | 8/1982 | Steck et al. | |
| 4,400,432 | A | 8/1983 | Buxbaum et al. | |
| 4,465,608 | A | 8/1984 | Gerum et al. | |
| 4,602,957 | A * | 7/1986 | Pollock et al. | 75/246 |
| 4,756,933 | A * | 7/1988 | Quack et al. | 427/388.4 |
| 4,927,461 | A | 5/1990 | Ciloglu et al. | |
| 4,927,473 | A | 5/1990 | Ochiai et al. | |
| 4,931,198 | A | 6/1990 | Arase et al. | |
| 5,198,137 | A | 3/1993 | Rutz et al. | |
| 5,268,140 | A | 12/1993 | Rutz et al. | |
| 5,306,524 | A | 4/1994 | Rutz et al. | |
| 5,543,174 | A | 8/1996 | Rutz | |
| 5,569,333 | A | 10/1996 | Takahashi | |
| 5,798,177 | A | 8/1998 | Jansson | |
| 5,980,603 | A | 11/1999 | Thomas et al. | |
| 6,054,219 | A | 4/2000 | Satsu et al. | |
| 6,331,270 | B1 | 12/2001 | Lefebvre et al. | |
| 6,344,273 | B1 | 2/2002 | Satsu et al. | |
| 6,348,265 | B1 | 2/2002 | Jansson et al. | |
| 6,372,348 | B1 | 4/2002 | Hanejko et al. | |
| 6,537,389 | B1 | 3/2003 | Aichele et al. | |
| 6,548,012 | B2 | 4/2003 | Lefebvre et al. | |
| 6,635,122 | B2 | 10/2003 | Hanejko et al. | |
| 6,689,184 | B1 * | 2/2004 | Morris | 75/246 |
| 6,720,074 | B2 | 4/2004 | Zhang et al. | |
| 6,756,118 | B2 | 6/2004 | Aichele et al. | |
| 6,870,047 | B2 | 3/2005 | Kleiber et al. | |
| 7,029,769 | B2 | 4/2006 | Tajima et al. | |
| 7,060,350 | B2 | 6/2006 | Takaya et al. | |
| 7,371,830 | B2 | 5/2008 | Kleiber et al. | |
| 2002/0023693 | A1 | 2/2002 | Lefebvre et al. | |
| 2002/0039667 | A1 * | 4/2002 | Takaya et al. | 428/692 |
| 2003/0134152 | A1 | 7/2003 | Hayashi et al. | |
| 2003/0230362 | A1 | 12/2003 | Tajima et al. | |

FOREIGN PATENT DOCUMENTS

| | | | |
|---|---|---|---|
| EP | 1 783 135 | A2 | 5/2007 |
| EP | 1800774 | A2 | 6/2007 |
| GB | 311 677 | | 5/1929 |
| GB | 2 007 113 | A | 5/1979 |
| JP | 52-67798 | A | 6/1977 |
| JP | 55-138205 | A | 10/1980 |
| JP | 57-64904 | A | 4/1982 |
| JP | 57-129828 | A | 8/1982 |
| JP | 57-161006 | A | 10/1982 |
| JP | 58-159311 | A | 9/1983 |

(Continued)

OTHER PUBLICATIONS

Machine translation of JP 06-195684 A (Japanese document cited by applicant).*

Narita et al., "Synthesis and structures of iron nanoparticles coated with boron nitride nanomaterials", Journal of Electron Microscopy 55(3):123-127 (2006).

*Primary Examiner* — Jessee Roe

*Assistant Examiner* — Christopher Kessler

(74) *Attorney, Agent, or Firm* — Fitzpatrick, Cella, Harper & Scinto

(57) ABSTRACT

The present invention relates to ferromagnetic powders with an electrically insulating layer on iron particles intended for the manufacture of components having improved soft magnetic properties at low and medium frequencies. The invention comprises an iron powder coated with a dielectric insulating layer comprising boron bearing compounds to form an insulated ferromagnetic powder. The present invention also relates to a method of making these insulated ferromagnetic powders. The present invention further relates to a method of synthesizing a product made from insulated ferromagnetic powders via a post-heat treatment at a moderate temperature (300° C. to 700° C.), to form a glass-like coating which acts as an electrical insulator. A preferred embodiment of the present invention is obtained when small amounts of alkali bearing compounds are added to the precursors to modify the coating chemistry and significantly increase the electrical resistivity after heat treatment.

53 Claims, 12 Drawing Sheets

(56) References Cited

FOREIGN PATENT DOCUMENTS

| | | | |
|---|---|---|---|
| JP | 59-170202 | A | 9/1984 |
| JP | 59-227730 | A | 12/1984 |
| JP | 1048406 | A | 2/1989 |
| JP | 3-61307 | A | 3/1991 |
| JP | 5-20677 | A | 1/1993 |
| JP | 5-81649 | A | 4/1993 |
| JP | 6-195684 | A | 7/1994 |
| WO | 95/29490 | | 11/1995 |
| WO | 97/30810 | | 8/1997 |
| WO | 00/30835 | | 6/2000 |

* cited by examiner

INSULATED IRON-BASE POWDER FOR SOFT MAGNETIC APPLICATIONS

BACKGROUND OF THE INVENTION

1. Field of the Invention

The present invention relates to ferromagnetic powders with an electrically insulating layer on iron particles intended for the manufacture of components having improved soft magnetic properties at low and medium frequencies. The invention comprises an iron powder coated with a dielectric insulating layer comprising boron (B) bearing compounds to form an insulated ferromagnetic powder. The present invention also relates to a method of making these insulated ferromagnetic powders. The present invention further relates to a method of synthesizing a product made from insulated ferromagnetic powders via a post-heat treatment at a moderate temperature (300° C. to 700° C.), to form a glass-like coating which acts as an electrical insulator. A preferred embodiment of the present invention is obtained when small amounts of alkali bearing compounds are added to the precursors to modify the coating chemistry and significantly increase the electrical resistivity after heat treatment.

This invention concerns the utilization, at low to medium frequency magnetic solicitations, of ferromagnetic materials such as elemental iron (Fe), nickel (Ni) and cobalt (Co) or other Fe, Ni and Co based magnetic alloys. Such materials are characterized by a high permeability μ, defined as the degree of magnetization of a material in response to a given magnetic field; $B_{max}$, a specific saturation point (also designated "saturation induction point") over which no further magnetic induction can be created in the material; and $B_r$, a certain amount of residual induction remaining when the applied magnetic field is released.

The magnetic materials used in this invention are named soft magnetic as opposed to hard magnetic materials as they can be easily magnetized and demagnetized by an external magnetic field. The magnetic induction created in these materials when magnetized can be reduced to zero by applying a reverse magnetic field of strength $H_c$, known as the coercive field. Broadly, hard magnetic materials are those with coercivities above 10 kA/m while soft magnetic materials are those with coercivities below 1 kA/m. Note that properties like coercive field, remanent induction and permeability are strongly dependent on the condition of the material. These properties are affected by such factors as heat treatment or deformation whereas maximum induction is mainly determined by the nature of the soft magnetic material (e.g., composition, density).

When magnetically solicited, a fraction of the energy used to magnetize a soft magnetic material is dissipated in the form of thermal energy. At low frequency, hysteresis phenomena, defined by the irreversible variation in the magnetization associated with a change in the magnetic field strength, dominate and are responsible for most of the core losses. However, as the frequency of solicitation increases, eddy currents are created in the soft magnetic material. This, in turn, generates a magnetic field opposed to the applied external magnetic field. These eddy current losses result in a decrease of the effective cross-section of a part that can be magnetized. Eddy current losses can be decreased by either increasing the material resistivity or by splitting the magnetic circuit into smaller parts (e.g., laminations, particles).

2. Description of Related Art

Insulated Ferromagnetic Powders

Iron-based powders are currently used in conventional powder metallurgy to elaborate structural parts using compaction and high temperature sintering operations. A majority of these parts are used in the automotive industry due to their mechanical attributes. In the last several decades, metal powders have also been used to elaborate sintered components in which the magnetic property of the material is functionally important. Applications in this field include hard as well as soft magnetic devices normally intended for direct-current (DC) magnetic solicitation.

More recently, soft magnetic powder materials for low to high frequency applications have been developed. These materials consist of iron-based powders insulated by an organic or inorganic coating which limits eddy current losses when frequency increases. These insulated ferromagnetic powders are also consolidated using a compaction step but, in contrast to the standard powder metallurgy practice, they are not sintered. Instead, insulated ferromagnetic powders are heat-treated at temperatures lower than 700° C. in order to stress-relieve the parts without creating a metallurgical bonding between particles.

The resulting insulated ferromagnetic powder parts, also known as soft magnetic composites (SMC), are intended to replace electrical sheets. Electrical sheets present some drawbacks. One such drawback is that the punching step may induce mechanical stresses which decrease the magnetic properties of the material. This operation produces a certain amount of scrap. It is also usually required that the punched laminates be deburred in order to remove the sharp edges. Furthermore, depending on the sheet thickness and material quality, core losses and acoustical noise increase significantly at higher frequency. Finally, electrical sheets can only carry the magnetic flux in the 2D plane of the sheet thus limiting feasible machine designs.

Advantages of SMC over the electrical sheets are the following. First, because of their isotropic nature, the magnetic flux can also be carried in the third dimension thus allowing designers to decrease the outside diameter of the electrical motors while maintaining a similar torque and efficiency. Second, due to the reduction of eddy current losses, SMC materials have lower total core losses than electrical steels at a frequency higher than about 400 Hz to 1000 Hz, depending on the comparative material. Finally, the powder metallurgy process route allows the production of complex part shapes with no material loss while simultaneously minimizing the number of production steps.

Despite its advantages, SMC materials present some limitations. When compared to electrical steels, the maximum magnetic permeability of SMC is relatively low and makes them less preferable in applications where permeability is critical. Examples of lesser critical permeability applications are permanent magnet electrical motors in which a large air gap already exists between the stator and the rotor, to accommodate the magnets. Furthermore, SMC have higher hysteresis losses than electrical steels, thus limiting their use at low frequency (e.g., 60 Hz). Finally, because of their porous nature and non-sintered state, these materials have a lower mechanical strength than laminated materials.

Dielectric Coating

A critical parameter and main challenge in the fabrication of insulated ferromagnetic powders is the surface coating of the iron particles. The surface coating should be as thin as possible in order to minimize the attenuation of the magnetic flux while also presenting maximum dielectric properties. These dielectrics are categorized in two groups: organic and inorganic coatings. Organic coatings normally offer a higher mechanical strength but the allowable stress-relief temperature is limited to about 300° C. Inorganic coatings allow the SMC material to be heat-treated at higher temperatures thus maximizing the material magnetic properties.

Inorganic types of coatings have been developed in the form of borate glass-like coatings in order to maximize the magnetic properties of resulting materials. The dielectric properties of these inorganic glass-like coatings are highly dependent on their composition. In glass science, it is well known that the glass DC electrical conductivity is related to the ionic charge. For example, borates and phosphates naturally form negatively charged glasses, which can be changed using network modifier elements. These network modifiers, usually present in the alkaline and alkaline earth groups, interact with the glass former elements and decrease their network cross-linking. This phenomenon decreases the glass transition temperature and, furthermore, neutralizes the glass ionic charge thus limiting current transportation.

Processing of SMC Parts

Processing conditions of SMC materials strongly influence their final magnetic properties. For instance, in order to maximize the magnetic induction in such SMC materials, compacting pressures can be increased and the tooling heated to maximize the final density thus providing a direct effect on the magnetic induction. An important step in the processing is the post heat treatment which relieves partly the stresses induced in these materials during the compaction step. This stress-relief heat treatment can be done in air and, ideally, at the highest possible temperature in order to decrease the material coercive field while maintaining a relatively high electrical resistivity (to avoid metallurgical bonding between particles). Also, depending on the solicitation frequency of the application, the amount of dielectric and powder particle size can be adjusted. For instance, as frequency increases, finer particles and higher amounts of dielectric are required in order to minimize core losses. However, this will negatively affect the maximum permeability.

Electrical Applications

As mentioned earlier, this invention is intended for low to medium frequency soft magnetic applications. Examples of applications suitable for SMC materials include, but are not limited to, DC motors (with brushes or brushless), alternating-current (AC) motors (induction and synchronous), transformers, inductors, linear motors and voice coils.

REFERENCES OF INTEREST

Numerous patents have been filed on insulated iron-based powders for soft magnetic applications. Most of them, however, describe phosphate-based coatings. For instance, phosphate-coated iron powders such as those described in WO 97/30810 (Höganas) are obtained by treating the base powder with orthophosphoric acid ($H_3PO_4$) in an organic solvent at a concentration between 0.5% and 20% (2.5 to 120 ml of solution per kg of iron powder). The O:P ratio in the thin coating layer as measured by ESCA method is between 1 and 30 and the total oxygen content is at most 0.2% higher than that of the base powder. In U.S. Pat. No. 6,344,273 (Hitachi), the phosphating solution contains a surfactant and a rust inhibitor, this latter being an organic compound containing nitrogen and/or sulphur having a lone pair of electrons suppressing the formation of iron oxide. The water base phosphate solution includes also a certain amount of at least one of magnesium (Mg), tin (Sn), manganese (Mn), cadmium (Cd), and calcium (Ca).

There are also many other variants of coatings containing phosphate and borate glasses network formers. For example, the U.S. Pat. No. 7,029,769 (Toyota) describes an insulating film which comprises two elements. The first element is a glassy insulation film which includes network former elements such as boron (B), phosphorous (P), oxygen (O) and iron and the second element generates cations whose hexa-coordinated ion radius, defined by Shannon, R. D., is 0.073 nm or more, and which are bivalent or more. This second element such as calcium (Ca), strontium (Sr) and yttrium (Y) is incorporated in the insulation film as a network modifier to improve its thermal resistance. As precursor of the insulation film, boric acid is used in proportion 3 to 10 times lower than phosphoric acid.

U.S. Pat. No. 6,756,118 (Bosch) describes the method of producing a powdered metal composite having a high specific resistivity, which contains at least two oxides encapsulating the powder forming at least one common phase. The starting material contains the iron powder and at least two antitack agents which leave an oxide residue when pyrolysed forming one phase of glass and a mixed oxide having a spinel structure, metal phosphates and metal silicates. The antitack agent may include metal soaps (metallic stearates) and phosphoric acid, boric acid, silicic acid in the form of silane in total proportion relative to the weight of powder metal between 0.2% and 3%.

In some cases, polymers are used in conjunction with inorganic coatings. For instance, U.S. Pat. No. 6,537,389 (Bosch) discloses a wide range of silicon (Si), aluminum (Al) or boron (B) containing compounds with a predominantly polymeric nature used as precursors to produce an electrically insulating layer on soft magnetic powders by pyrolysis. Also, WO 00/30835 (Höeganeas) describes the methods of preparing and using an annealable insulated metal-based powder. This material is made out of at least one inorganic compound (which can be boron oxide) and at least one organic polymeric layer. In these cases, the use of an organic polymer usually increases the thickness of the insulating film and decreases the achievable maximum permeability of the material.

BRIEF SUMMARY OF THE INVENTION

The main objective of the present invention is to produce a soft magnetic composite material with improved properties for applications in the low to medium frequency range (50 to 10,000 Hz). This normally implies the maximization of the material permeability and the minimization of its coercive field while maintaining a relatively high specific resistivity to minimize eddy current losses. A second objective of the present invention is to maximize the mechanical strength of the material measured by the transverse rupture strength test method (TRS).

DETAILED DESCRIPTION OF THE INVENTION

Figure 1:
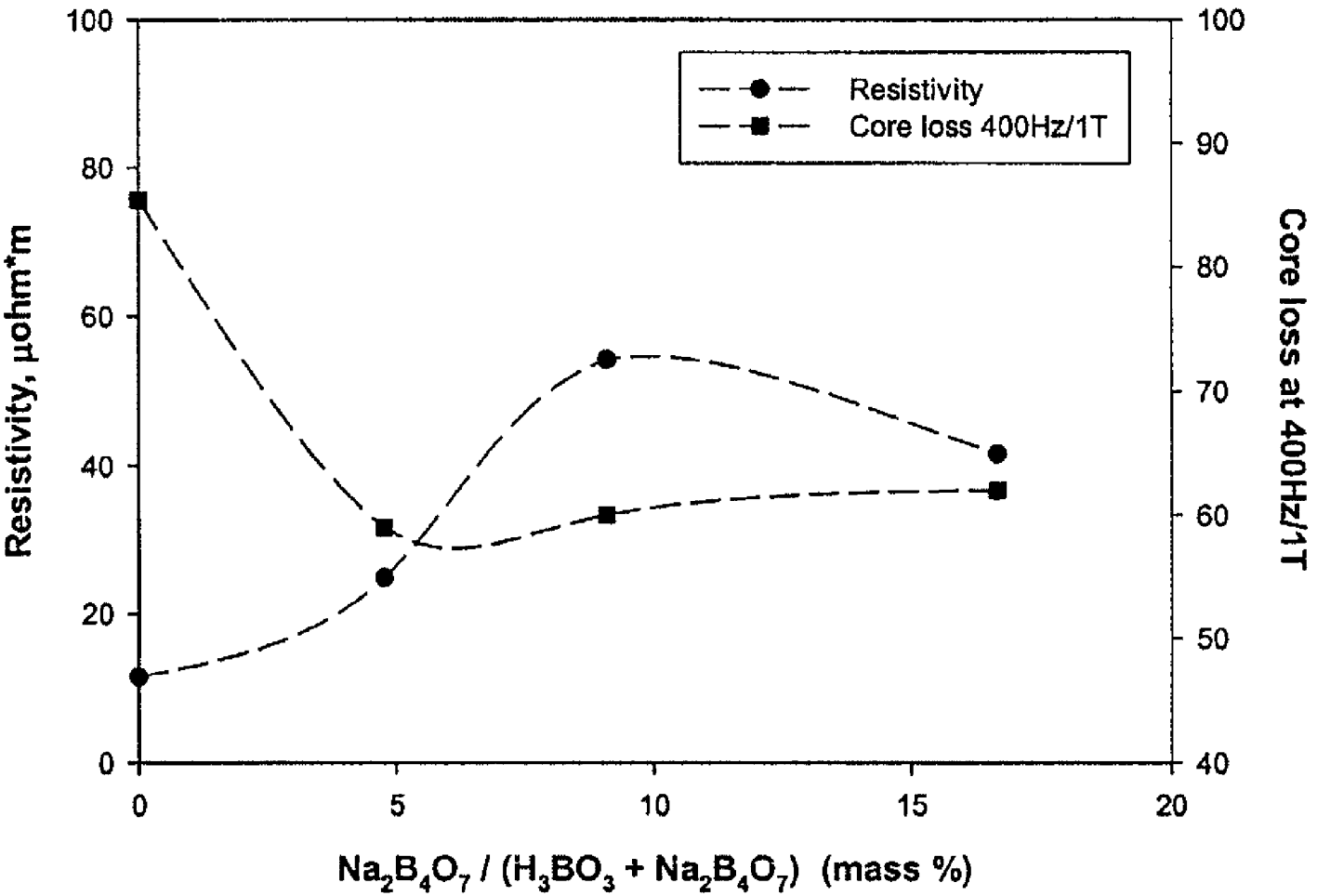
FIG. 1 illustrates $Na_2B_4O_7$ in the borate coating solution and its effect on resistivity and core losses (at 400 Hz and 1 T) of a product according to the present invention compacted at 490 MPa and heat treated at 500° C. for 30 min in air.

The present invention relates to ferromagnetic powders with an electrically insulating layer on iron particles intended for the manufacture of components having improved soft magnetic properties at low and medium frequencies. The invention comprises an iron powder with boron bearing compounds. The present invention also relates to a method of making these insulated ferromagnetic powders. The present invention further relates to a method of synthesizing a product made from insulated ferromagnetic powders via a post-heat treatment at a moderate temperature (300° C. to 700° C.), to form a glass-like coating which acts as an electrical insulator. A preferred embodiment of the present invention is obtained when small amounts of alkali bearing compounds are added to the precursors to modify the coating chemistry and significantly increase the electrical resistivity after heat treatment.

More precisely, the magnetic material used as a major element in this invention may be any ferromagnetic element such as the transition elements of group VIII (e.g. Fe, Ni, Co) and their alloys suitable for magnetic applications (e.g., Fe—Ni alloys, Fe—Si alloys, Fe—P alloys, Fe—Co alloys, etc.). Considering availability and process cost, a high purity iron powder is preferred. A high purity iron powder is characterized by a low content of interstitial residual elements. For instance, the typical concentration of carbon, oxygen, sulfur and nitrogen found in these powders is: carbon≤0.005%, oxygen≤0.1%, sulfur≤0.005% and nitrogen≤0.001%. ATOMET® 1001HP manufactured by QMP is an example of such a high purity iron powder. This iron powder is coated with a boron-bearing compound to synthesize a borate glass-like network when heat-treated. The main precursor used for this purpose is orthoboric acid ($H_3BO_3$). However, other compounds, such as metaboric ($HBO_2$) acid, tetra boric ($H_4B_4O_7$) acid, ammonium tetraborate, pentaborate and peroxyborate could also be used.

In the present invention, addition of the alkali compounds is essential to modify the glass network and increase the resistivity of the resulting powder coating. Without being bound by this theory, the inventors believe the alkali elements (with their positive charge) neutralize the natural ionic negative charge of the glass network. This neutralization is achieved for a limited range of molar proportions, which is lower than about 15%. Above this level, a positive ionic conductivity is created and resistivity of the coating decreases. All alkali elements, such as lithium (Li), sodium (Na), potassium (K), rubidium (Rb), cesium (Cs), and francium (Fr), used alone or in combination, can produce this neutralizing effect. The addition of these network modifiers is made using various sources of primary alkali compounds soluble in organic solvents and/or water solution. Alkali hydroxides such as LiOH, NaOH or KOH are good examples. However, alkali salts including, but not limited to, alkali carbonate, borate, phosphate and silicate compounds such as $Na_2CO_3$ (sodium carbonate), $Na_2B_4O_7$ (Borax), $NaH_2PO_4$ (sodium phosphate) or $Na_2SiO_3$ (sodium silicate) may also be used alone or in any combination thereof.

The coating on the iron particles is produced using a wet-coating process and can be realized either by solution spraying or complete immersion of the iron powder. In the present invention, the solution spraying method is preferred. The precursor acid solution and the solution containing the alkali element compounds can be sprayed separately on the iron-based powder in a mixing step or can be mixed together before spraying. Organic solvents such as ethanol, methanol, acetone, isopropyl alcohol and glycerol can be used and, typically, the acid solutions are in concentration between 0.5% and 30% mass. The total quantity of solutions sprayed onto the iron particles is between 1 and 50 ml per kg of iron powder. The corresponding proportion of glass precursors with respect to iron is preferably lower than 0.3% and more preferably under 0.1% mass.

The solutions may also include a certain proportion of water when alkali compounds are not totally soluble in organic solvents. This addition of water improves the coating efficiency by increasing the dissociation constant of the solution thus increasing the acid and alkali elements reactivity with the iron powder. However, the relative proportion of water in the organic solvent must be kept low to prevent any rust formation. A mixing time of between 5 and 90 minutes is applied in order to homogenize the coating thickness. The wet-coated particles are then dried at low temperature (below 200° C.), at normal pressure or under a vacuum atmosphere, in order to eliminate all traces of solvent thus leaving the dielectric coating on the surface of the particles.

The dry coated powder thus obtained is then mixed with a lubricant powder which may be any lubricant known for powder metallurgy applications. For example, it can be selected from synthetic waxes, amine-based waxes, metallic stearates, polymeric lubricants or fatty acids. The preferred proportion is between 0.2% and 1% and, more preferably, between 0.3% and 0.7% as the amount of added lubricant limits the maximum achievable density. This lubricated powder mix is then compacted in a rigid die. Note that a minimum proportion of lubricant is required to avoid the degradation of the coating during the powder compaction step. The compacting temperature and pressure can be varied in order to achieve the desired part density. According to the present invention, compacting pressures of up to 1,500 MPa can be used. Compacting pressures of between 300 and 1,000 MPa typically is applied with the tooling at room temperature, though pressures between 400 and 1,000 MPa are preferred. The compaction can also be made in a heated rigid die in order to further increase the density. Preferably, and more realistically, the compaction pressures used are between 600 and 850 MPa and the temperature of the die is limited to 125° C.

Finally, the obtained green parts or magnetic cores, so-called soft magnetic composites (SMC), are heat-treated at a moderate temperature between 300° C. and 700° C. The thermal treatment duration may be adjusted in function of the final magnetic properties required for a given application but it lasts preferably between 5 and 60 minutes. Various atmospheres can be used to heat-treat the parts such as inert gas atmospheres (nitrogen, argon) and oxidizing atmospheres (air, oxygen, mix hydrogen/water vapor). The gas flow rate and other thermal treatment conditions may be varied to optimize the magnetic properties of the parts or the magnetic cores produced. Post heat treatment allows for complete or partial burnout of the lubricant in the parts, a complete dehydration of the precursors and an in-situ synthesis of the desired glass-like composition. The main role of this glass is to efficiently insulate the iron particles from each other in order to minimize the eddy currents induced in the magnetic core when submitted to an oscillating field.

Scope of the Invention:

Ferromagnetic Powder

The iron powder used in this invention is preferably a high purity water-atomized iron powder such as the ATOMET® 1001HP produced by water atomization with a particle size distribution ranging from 5 μm up to 250 μm. For low frequency applications, coarser iron powders, such as ATOMET® 580 with particles larger than 45 μm, may be used favorably in order to maximize permeability and reduce the material coercive field. In contrast, higher frequency applications require finer powders such as ATOMET® 545, with particles smaller than 45 μm in order to further reduce eddy currents.

Dielectric

In a preferred formulation of this invention, the major dielectric constituent of the coating is produced by the dehydration of boric acid ($H_3BO_3$) into boron oxide ($B_2O_3$) through thermal activation. This glass-network former oxide coats and insulates the surface of the iron particles thus avoiding the circulation of eddy currents. In order to neutralize the ionic conductivity of this glass and to lower its glass transition temperature, a small quantity of alkali compounds is added. For practical and economical reasons, sodium borate ($Na_2B_4O_7$) is the preferred alkali compound. Many grades of $Na_2B_4O_7$ can be used, the difference being mainly in the amount of water molecules coupled with the $Na_2B_4O_7$. Other types of alkali compounds can also be used with similar results, as will be demonstrated in Example 2.

As illustrated in the following two examples, the essence of the invention is in the optimization of the alkali elements additions in function of the various glass-like insulating layers formed. The optimal effect of the alkali elements is obtained in a limited range of molar proportions. This range varies with the glass-like network formed, the alkali element used and its form (e.g., salt, hydroxide or other compound) and the interaction between them when they are combined.

EXAMPLE 1

Effect of the Relative Proportion of Alkali Compound

In this example, the ferromagnetic powder used is the high purity ATOMET® 1001 HP iron powder with a particle size ranging from 5 μm up to 250 μm. Two base solutions were prepared: solution A containing 6 grams of boric acid $H_3BO_3$ (Borax Optibor grade) in 100 ml of ethanol or 6% (m/v) and solution B containing 3 grams of the alkali compound $Na_2B_4O_7*10H_2O$ in 100 ml of water (Borax Decahydrate) or 3% (m/v).

From these base solutions, four reaction solutions were prepared by combining 10 ml of solution A to 0, 1, 2 or 4 ml of solution B. Four coated iron powders or samples were prepared by mixing one kilogram of ATOMET® 1001 HP iron powder with each of the reaction solutions (10 to 14 ml solution/kg of iron). After coating, the powders were dried at 100° C. for 60 minutes, mixed with 0.5% Kenolube lubricant and pressed at 690 MPa into rectangular test bars (31.7 mm long×12.7 mm wide×6.35 mm thick) and magnetic core rings (52.5 mm OD×43.6 mm ID×6.3 mm thick). These pressed SMC samples (with density of about 7.25 g/cm$^3$) were heat-treated at 500° C. for 30 minutes in air. The electrical resistivity of the bars was determined using a 4-point method (DRM-40 micro ohmmeter from NDG Technologies and probe with 8 mm spaced electrodes).

As for all results presented herein, magnetic properties were evaluated on heat treated ring samples using a MPG 1000 hysteresis graph from Brockhaus Messtechnik. A winding combination of 200 primary turns and 100 secondary turns was used to evaluate both the direct-current (DC) properties at 12,000 A/m and the AC core losses at 60 Hz and 400 Hz at a fixed induction of 1 Tesla.

Experimental conditions and results for these trials are reported in Table I. The electrical resistivity increases significantly with the addition of the alkali compound in the borate coating. In fact, the resistivity obtained using boric acid alone is around 12 μohm*m. When Na is added, the resistivity increases up to 54 μohm*m for a relative proportion of 10% of $Na_2B_4O_7$ in boric acid, as illustrated in FIG. 1. This gain in resistivity is important for AC applications as it results in a decrease of the losses, mainly eddy current losses. For instance, core losses at 400 Hz/1 T decrease from around 85 W/kg, when only boric acid is used, down to an optimal value of about 60 W/kg, when the resistivity is maximized.

TABLE I

Effect of the $Na_2B_4O_7*5H_2O$ Proportion (Solution B) in Boric Acid (Solution A) on Properties of SMC Bars and Rings Pressed at 690 MPa After Heat Treatment (500° C./30 min/air).

| | Solution (ml/kg) | | Density | TRS | Resistivity | $B_{max}$ at 12 kA/m | | $H_c$ | Core loss at 1 T (W/kg) | |
|---|---|---|---|---|---|---|---|---|---|---|
| Trial | A | B | g/cc | MPa | μohm * m | T | $\mu_{max}$ | A/m | 60 Hz | 400 Hz |
| 1 | 10 | 0 | 7.24 | 51 | 12 | 1.48 | 470 | 278 | 8.3 | 85 |
| 2 | 10 | 1.0 | 7.25 | 61 | 25 | 1.50 | 450 | 279 | 7.1 | 59 |
| 3 | 10 | 2.0 | 7.24 | 59 | 54 | 1.44 | 400 | 283 | 8.1 | 60 |
| 4 | 10 | 4.0 | 7.27 | 56 | 42 | 1.41 | 360 | 283 | 7.6 | 62 |

EXAMPLE 2

Effect of the Nature of the Alkali Compound

In this example, it is demonstrated that good results can also be obtained by using other alkali compounds such as, alkali phosphates and alkali silicates, in which cases binary and ternary glass compositions are obtained. Different reaction solutions were prepared by mixing solution A containing 6% (m/v) boric acid ($H_3BO_3$) in ethanol with various alkali 3% (m/v) solutions such as $Na_2B_4O_7$*$10H_2O$ (from Borax), $Na_2O$:$3SiO_2$ (from PQ Corporation) or $NaH_2PO_4$*$2H_2O$ (from Fisher Scientific) in water solutions named respectively solution B (from Example 1), C and D. In the three types of coating, Na is the alkali element, B is the major glass former element and P or Si are minor glass modifiers which change slightly the structure of the borate glass network. The three formulations of coated iron powders were prepared by mixing one kilogram of ATOMET® 1001 HP iron powder with 10 ml of the boric acid solution and 0, 1, 2 or 4 ml of each alkali solution. After coating, the powders were dried at 100° C. for 1 hour, mixed with 0.5% Kenolube lubricant and pressed as in the preceding example. Again, the SMC bars were heat-treated at 500° C. for 30 minutes in air. Physical properties and experimental conditions are summarized in Table I, II and III.

Figure 2:
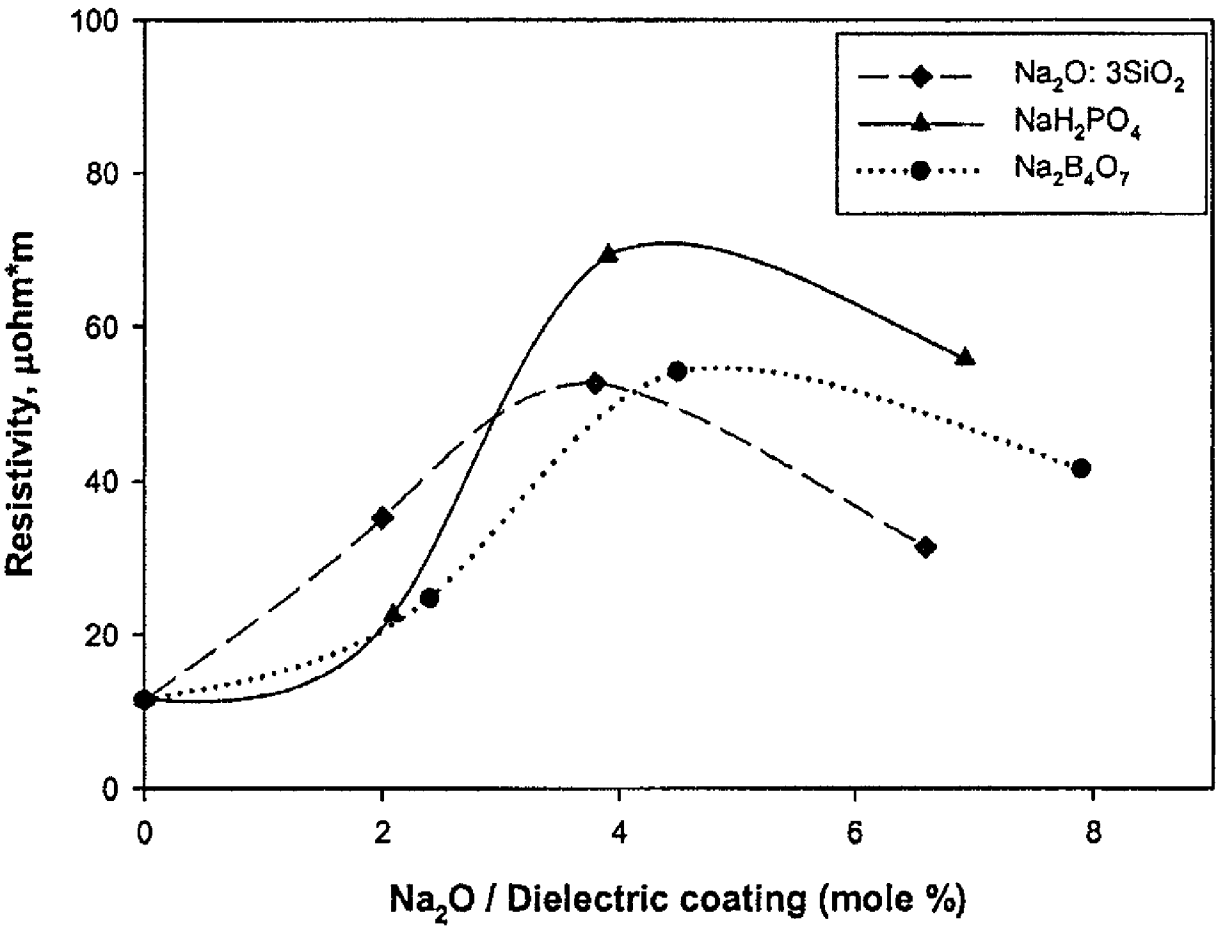
FIG. 2 illustrates borate coating solutions containing $Na_2O$ for three types of alkali compounds and the $Na_2O$ effect on the resistivity of a product according to the present invention heat treated at 500° C. for 30 minutes in air.

Resistivity values as a function of the molar proportion of $Na_2O$ in the glass-like coating solutions are plotted in FIG. 2. The molar proportion of sodium maximizing the resistivity of the SMC varies from about 3 to 5 mole % depending on the alkali compound type and glass network structure synthesized.

TABLE II

Effect of the $Na_2SiO_3$ Proportion (Solution C) in Boric Acid (Solution A) on Properties of SMC Bars and Rings Pressed at 690 MPa After Heat Treatment (500° C./30 min/air).

| | Solution (ml/kg) | | Density | TRS | Resistivity | $B_{max}$ at 12 kA/m | | $H_c$ | Core loss at 1 T (W/kg) | |
|---|---|---|---|---|---|---|---|---|---|---|
| Trial | A | C | g/cc | MPa | μohm * m | T | $\mu_{max}$ | A/m | 60 Hz | 400 Hz |
| 5 | 10 | 1.0 | 7.24 | 61 | 35 | 1.49 | 440 | 272 | 7.48 | 62.9 |
| 6 | 10 | 2.0 | 7.24 | 55 | 52 | 1.45 | 410 | 275 | 7.26 | 58.5 |
| 7 | 10 | 4.0 | 7.27 | 38 | 31 | 1.48 | 400 | 277 | 7.67 | 71.5 |

TABLE III

Effect of the $Na_2H_2PO_4$ Proportion (Solution D) in Boric Acid (Solution A) on Properties of SMC Bars and Rings Pressed at 690 MPa After Heat Treatment (500° C./30 min/air).

| | Solution (ml/kg) | | Density | TRS | Resistivity | $B_{max}$ at 12 kA/m | | $H_c$ | Core loss at 1 T (W/kg) | |
|---|---|---|---|---|---|---|---|---|---|---|
| Trial | A | C | g/cc | MPa | μohm * m | T | $\mu_{max}$ | A/m | 60 Hz | 400 Hz |
| 8 | 10 | 1.0 | 7.28 | 64 | 23 | 1.48 | 450 | 279 | 7.3 | 60.4 |
| 9 | 10 | 2.0 | 7.29 | 63 | 69 | 1.50 | 420 | 280 | 7.0 | 55.0 |
| 10 | 10 | 4.0 | 7.27 | 42 | 56 | 1.47 | 370 | 280 | 7.8 | 61.8 |

For each of the resulting borate, phosphoborate and silicoborate glass-like coating, the optimal molar proportion of alkali element that maximizes the electrical resistivity was determined. These optimal compositions and their corresponding maximum resistivity values are given in Table IV. The sodium borate and silicoborate glass networks give a similar maximum resistivity (54 and 53 μohm*m respectively) while the phosphoborate glass network gives a resistivity significantly higher (69 μohm*m). This is attributed to an improved thermal stability of the phosphoborate glass-like coating.

TABLE IV

Proportion of $Na_2O$ in the Total Borate Coating (10 ml/kg Fe of 6% Boric Acid in Ethanol) That Maximizes the Electrical Resistivity After Heat Treatment (500° C./30 min).

| Alkali additive | Glass network structure | $Na_2O$/Coating (mole %) | Max Resistivity μohm * m |
|---|---|---|---|
| $NaH_2PO_4$ | Phosphoborate | 3.9 | 69 |
| $Na_2B_4O_7$ | Borate | 4.5 | 54 |
| $Na_2SiO_3$ | Silicoborate | 3.8 | 53 |

EXAMPLE 3

Alkali Borate Coating Process

In this example, the variability of the process is demonstrated for an alkali borate glass coating formulation. For this purpose, 20 samples of 500 g were prepared using ATOMET® 1001 HP as the base iron powder and a wet-coating process according to the following steps. Different base solutions were prepared: 5% and 10% (m/v) boric acid $H_3BO_3$ (Borax Optibor grade) in ethanol and 2% and 5% (m/v) of the alkali compound $Na_2B_4O_7$*$5H_2O$ (sodium tetraborate pentahydrate) in water. The solutions were mixed together in different proportions and sprayed onto the iron powder and homogenized during 30 minutes in a laboratory blender. The coated powders were dried at 100° C. for one hour and mixed with 0.45% Kenolube. Rectangular bars and magnetic core rings were pressed at 690 or 830 MPa and heat-treated at 500° C. for 30 minutes in air. Density, transverse rupture strength and resistivity were measured on the rectangular bars while the magnetic properties were evaluated on the ring cores.

Table V presents the results obtained by coating the iron powder with various amounts of boric acid (glass former) and different proportions of sodium borate (glass modifier). Globally, the dielectric content increases from trial #11 to #26 (from 0.04% up to 0.12% mass) with the sodium tetraborate proportion varying between 0.003% up to 0.0125% with respect to the mass of iron powder.

TABLE V

Effect of Different Proportions of $Na_2B_4O_7*5H_2O$ and Boric Acid ($H_3BO_3$) on Properties of Pressed SMC Bars and Rings After Heat Treatment (500° C./30 min/air).

| | $H_3BO_3$ | | $Na_2B_4O_7*5H_2O$ | | Comp. | | | | $B_{max}$ at | | | Core loss at 1 T (W/kg) | |
|---|---|---|---|---|---|---|---|---|---|---|---|---|---|
| Trial | Conc. (m/V) | Vol. ml/kg | Conc. (m/v) | Vol. ml/kg | Press. MPa | Density g/cc | TRS MPa | Resis μohm * m | 12 kA/m T | $\mu_{max}$ | $H_c$ A/m | 60 Hz | 400 Hz |
| 11 | 5 | 8 | 2 | 1.5 | 830 | 7.34 | 39 | 29 | 1.54 | 450 | 270 | 7.2 | 72 |
| 12 | 5 | 8 | 2 | 2.5 | 690 | 7.27 | 52 | 20 | 1.49 | 420 | 287 | 8.2 | 80 |
| 13 | 5 | 8 | 5 | 1.5 | 690 | 7.27 | 55 | 17 | 1.47 | 440 | 280 | 8.4 | 84 |
| 14 | 5 | 8 | 5 | 2.5 | 830 | 7.36 | 46 | 25 | 1.52 | 420 | 291 | 8.0 | 77 |
| 15 | 5 | 12 | 2 | 1.5 | 690 | 7.27 | 46 | 25 | 1.46 | 410 | 302 | 8.7 | 87 |
| 16 | 5 | 12 | 2 | 2.5 | 830 | 7.35 | 39 | 35 | 1.50 | 430 | 279 | 7.7 | 71 |
| 17 | 5 | 12 | 5 | 1.5 | 830 | 7.35 | 43 | 28 | 1.55 | 430 | 278 | 7.3 | 70 |
| 18 | 5 | 12 | 5 | 2.5 | 690 | 7.26 | 58 | 18 | 1.47 | 430 | 283 | 7.6 | 74 |
| 19 | 10 | 8 | 2 | 1.5 | 690 | 7.26 | 63 | 80 | 1.45 | 390 | 316 | 8.6 | 69 |
| 20 | 10 | 8 | 2 | 2.5 | 830 | 7.34 | 46 | 72 | 1.48 | 400 | 301 | 8.2 | 64 |
| 21 | 10 | 8 | 5 | 1.5 | 830 | 7.36 | 44 | 95 | 1.49 | 390 | 287 | 7.1 | 57 |
| 22 | 10 | 8 | 5 | 2.5 | 690 | 7.26 | 60 | 49 | 1.46 | 400 | 304 | 8.1 | 67 |
| 23 | 10 | 12 | 2 | 1.5 | 830 | 7.33 | 39 | 51 | 1.45 | 340 | 299 | 7.5 | 65 |
| 24 | 10 | 12 | 2 | 2.5 | 690 | 7.30 | 84 | 140 | 1.45 | 370 | 340 | 9.0 | 68 |
| 25 | 10 | 12 | 5 | 1.5 | 690 | 7.25 | 65 | 38 | 1.40 | 340 | 323 | 8.6 | 78 |
| 26 | 10 | 12 | 5 | 2.5 | 830 | 7.34 | 46 | 126 | 1.51 | 380 | 304 | 7.3 | 57 |

Figure 3:
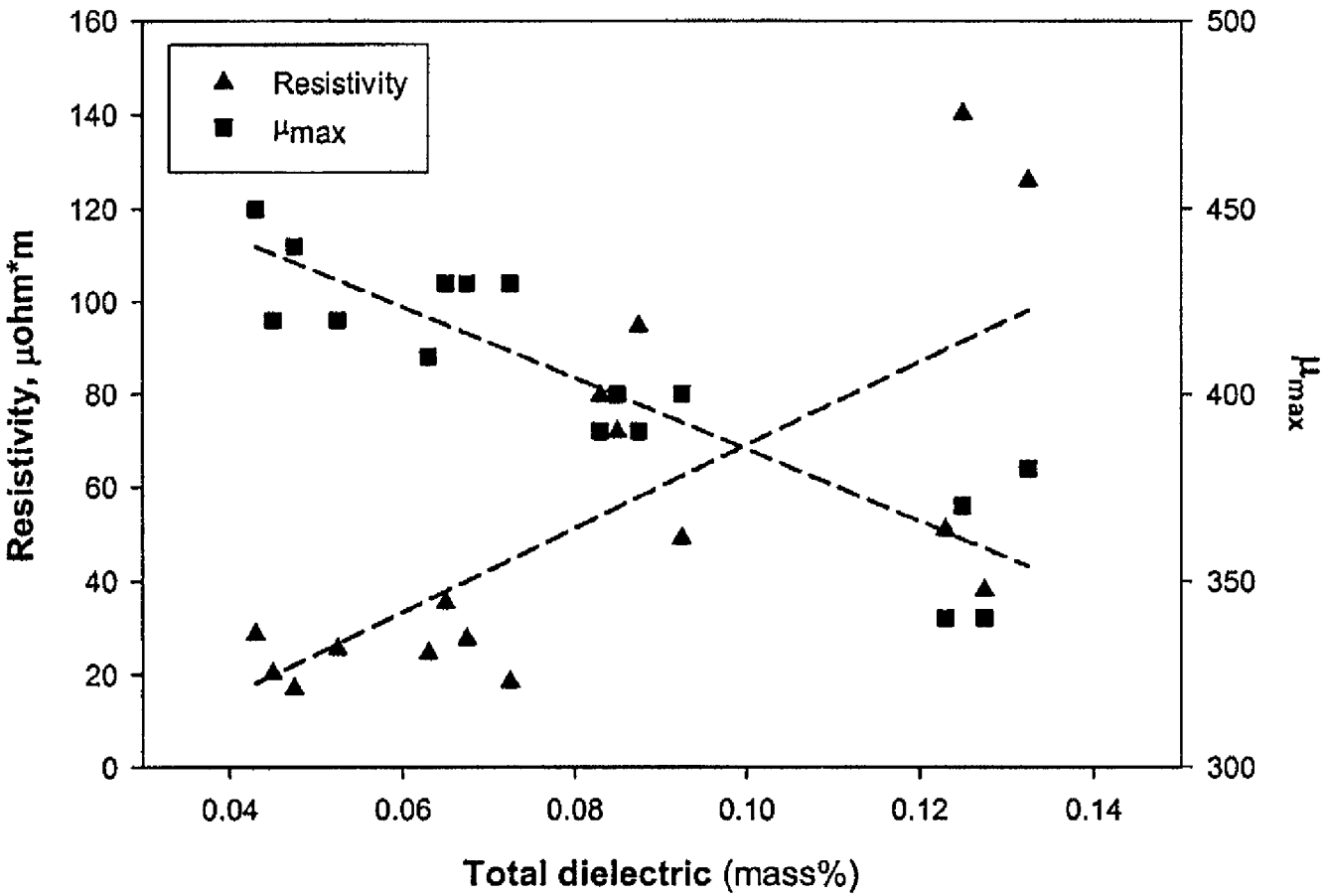
FIG. 3 illustrates the effect of total dielectric content (with mass % based on iron powder) on the final achievable resistivity and maximum permeability of a product according to the present invention.

These results illustrate the application limits of the invention. For instance, the effect of the total dielectric content on the electrical resistivity and maximum permeability is illustrated in FIG. 3. The resistivity of the SMC parts increases with an increase of the dielectric content which is beneficial in terms of core loss when frequency increases (e.g., at 400 Hz and 1 T) but detrimental in terms of maximum permeability. This phenomenon is explained by the fact that magnetic permeability and electrical resistivity are determined by the conditions at the interfaces between iron particles. An increase in the coating thickness corresponds to an increase in the air gap between iron particles which decreases the magnetic permeability. This in turn minimizes the number of metal-metal contacts and electrical resistivity of the composite material increases. The optimal composition of this invention is then a compromise between the achievable resistivity and maximum permeability. This optimum is achieved for a dielectric content between 0.08% and 0.10% with respect to the total amount of iron powder.

COMPARATIVE EXAMPLE

In order to illustrate the effect of the alkali addition in the borate coating, comparative examples are given in which boric acid alone was used (without alkali addition) to coat the iron powder. These coated powders were produced from the four basic coating formulations of Table V. The experimental conditions and results obtained for these plain borate formulations are presented in Table VI.

TABLE VI

Effect of the Boric Acid Content ($H_3BO_3$) on Properties of Pressed SMC Bars and Rings After Heat Treatment (500° C./30 min/air).

| | $H_3BO_3$ | | Comp. | | | | $B_{max}$ at | | | Core loss at 1 T (W/kg) | |
|---|---|---|---|---|---|---|---|---|---|---|---|
| Trial | Conc. (m/V) | Vol. ml/kg | Press. MPa | Density g/cc | TRS MPa | Resis μohm * m | 12 kA/m T | $\mu_{max}$ | $H_c$ A/m | 60 Hz | 400 Hz |
| 27 | 5 | 8 | 640 | 7.23 | 30.6 | 14.5 | 1.46 | 390 | 280 | 8.18 | 79.3 |
| 28 | 5 | 12 | 770 | 7.32 | 27.5 | 21.7 | 1.46 | 365 | 280 | 8.09 | 73.9 |
| 29 | 10 | 8 | 640 | 7.22 | 35.0 | 18.3 | 1.43 | 320 | 290 | 8.30 | 80.3 |
| 30 | 10 | 12 | 770 | 7.28 | 28.4 | 25.0 | 1.42 | 296 | 285 | 8.18 | 75.0 |

Figure 4:
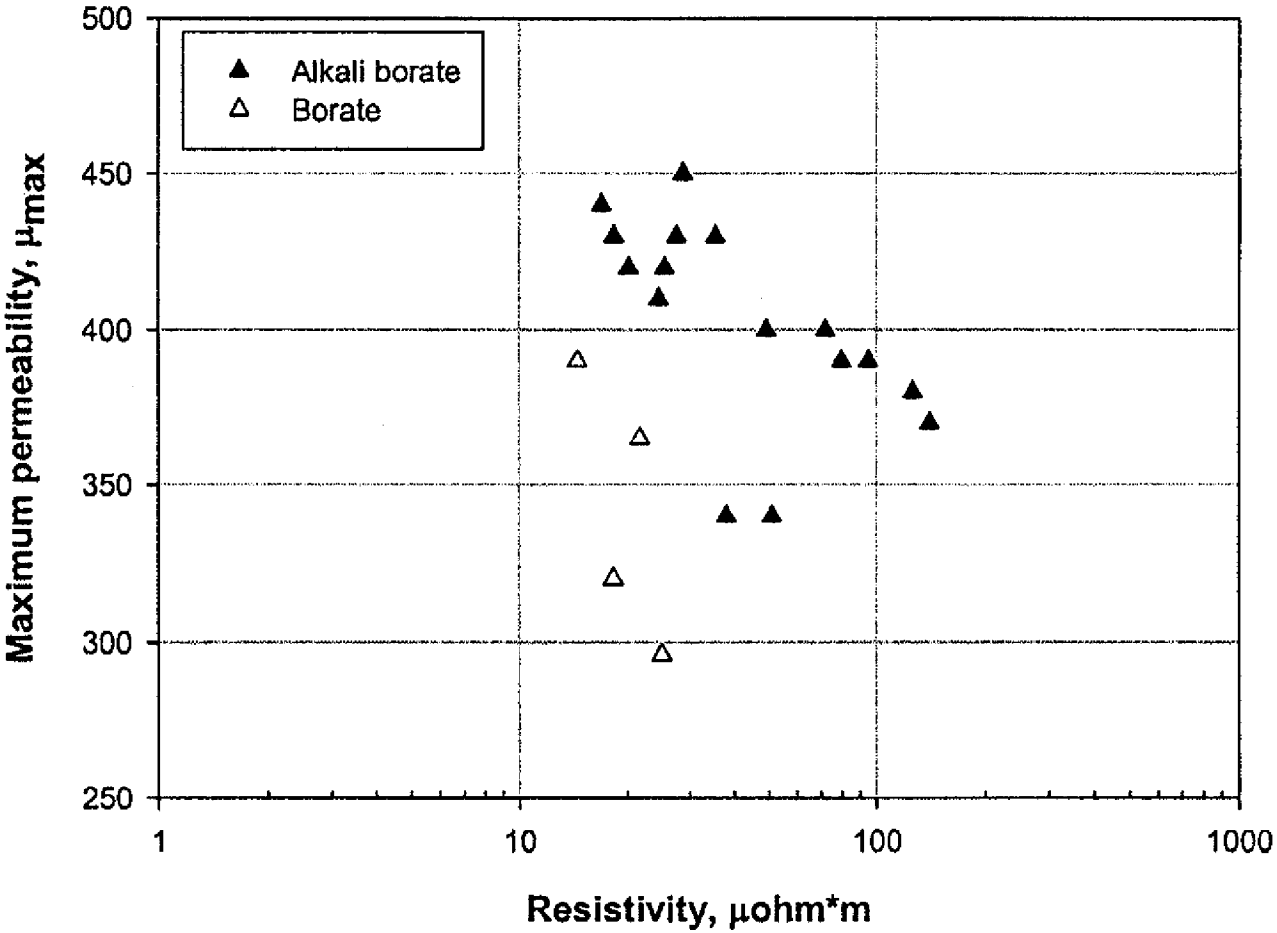
FIG. 4 illustrates the relationship between resistivity and maximum permeability for plain borate coatings and the alkali-modified borate coatings according to the present invention.

FIG. 4 plots the relation between maximum permeability and final resistivity of the soft magnetic materials containing plain borate coatings or alkali-modified borate coatings. For a comparable maximum permeability (e.g., $\mu_{max}$=400), the alkali borate coating presents a significantly higher resistivity than the borate coating (up to 10 times higher). FIG. 4 clearly shows that for similar amounts of dielectric coatings on the surface of the iron particles, the presence of alkali elements in the coating simultaneously increases the maximum permeability of the SMC material and its resistivity.

Figure 5:
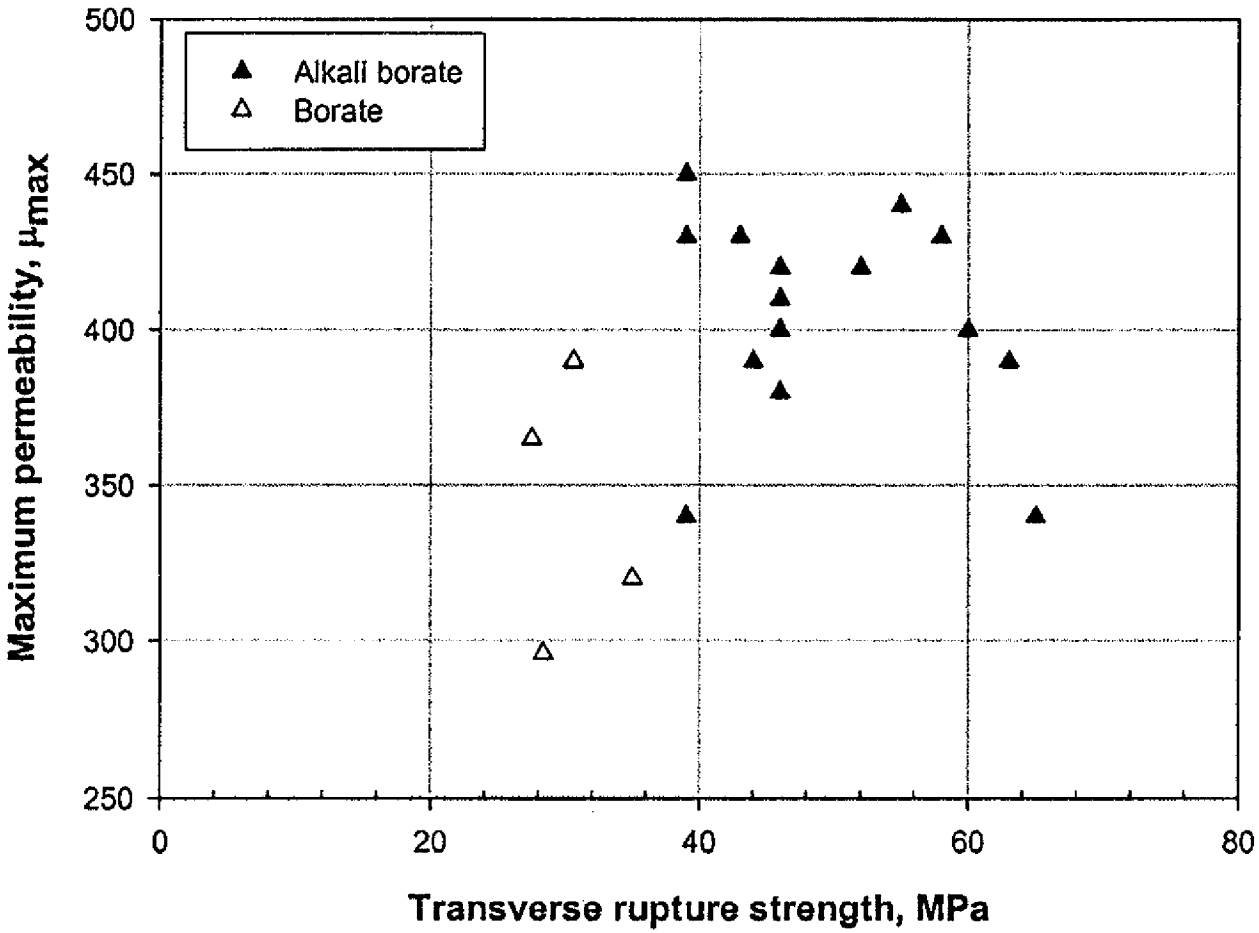
FIG. 5 illustrates the relationship between transverse rupture strength and maximum permeability for plain borate coatings and the alkali-modified borate coatings according to the present invention.

FIG. 5 shows another advantage offered by the alkali additions in the borate coating in terms of mechanical strength after a heat treatment at 500° C. for 30 minutes in air. In fact, at equivalent maximum permeability, an increase in strength of about 20 MPa is obtained when alkali elements are added in the dielectric borate glass coating.

Surface and Chemical Analyses

The dielectric coating composition and thickness of the iron coated powders of trials #11 to #26 were determined using a PHI-5700-2 X-ray Photoelectron Spectrometer (XPS). Coated iron powders were dried (100° C./h) and examined using a broad, low-energy resolution spectral acquisition (survey) in order to reveal the surface elemental composition of the first few atomic layers (~2 nm). Half of the samples were also examined using the XPS high-energy resolution spectral acquisition (multiplex) to determine the overall chemical composition (specific elements). Finally, the same samples were etched using an argon ion beam and examined in-situ, which provided elemental depth profiles and an evaluation of the approximate coating thickness.

Table VII summarizes the surface chemical analysis of the major elements forming the iron powder coating layer after drying at 100° C./h. Compared to the base iron powder (AT 1001 HP) which contains C, O, Mn and Fe mainly on its surface, the coated iron powders also contain boron (B) and sodium (Na) in various proportions. As expected, the amount of boron increases from 15 to 22 of the relative atomic percent with the increasing amount of dielectric deposited on the iron powder (from trial #11 to #26). The optimal glass coating composition is influenced by the O:B ratio (between 2.5 and 3.7) which represents the amount of boron network former element, as well as the Na:B ratio, which corresponds to the proportion of alkali network modifier element in the borate glass (typically between 0.02 and 0.13).

TABLE VII

XPS Surface Analysis of Base Iron Powder (A T1001 HP) and Dried Coated-Powders (100° C./1 h)

| | Relative Atomic Proportion (%) | | | | | | Ratio | |
|---|---|---|---|---|---|---|---|---|
| Trial | B | C | O | Na | Mn | Fe | O:B | Na:B |
| AT 1001 HP | — | 14.23 | 50.73 | — | 5.44 | 29.60 | — | — |
| 12 | 15.75 | 13.01 | 52.85 | 1.22 | 3.35 | 13.82 | 3.35 | 0.077 |
| 13 | 14.80 | 8.46 | 54.38 | 1.91 | 3.42 | 17.02 | 3.67 | 0.129 |
| 15 | 16.82 | 10.78 | 52.97 | 0.60 | 3.22 | 15.61 | 3.15 | 0.036 |
| 18 | 17.39 | 9.10 | 55.31 | 2.02 | 2.12 | 14.05 | 3.18 | 0.116 |
| 19 | 20.54 | 8.02 | 54.81 | 0.40 | 2.10 | 14.13 | 2.67 | 0.020 |
| 22 | 19.40 | 10.55 | 54.07 | 1.71 | 1.41 | 12.86 | 2.79 | 0.088 |
| 24 | 22.14 | 5.81 | 56.31 | 0.50 | 1.30 | 13.93 | 2.54 | 0.023 |

Figure 6A:
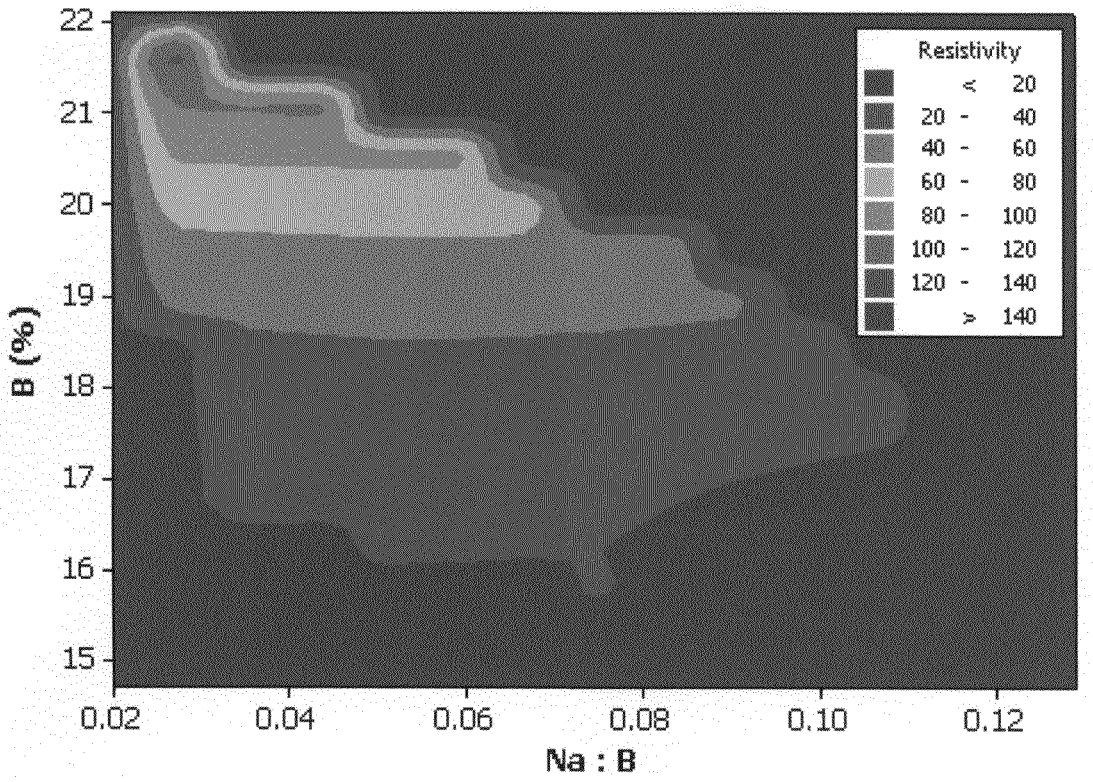
FIG. 6*a* illustrates the effect of boron glass network former amount (% B) and alkali element proportion (Na:B) on the resistivity of a product according to the present invention.
Figure 6B:
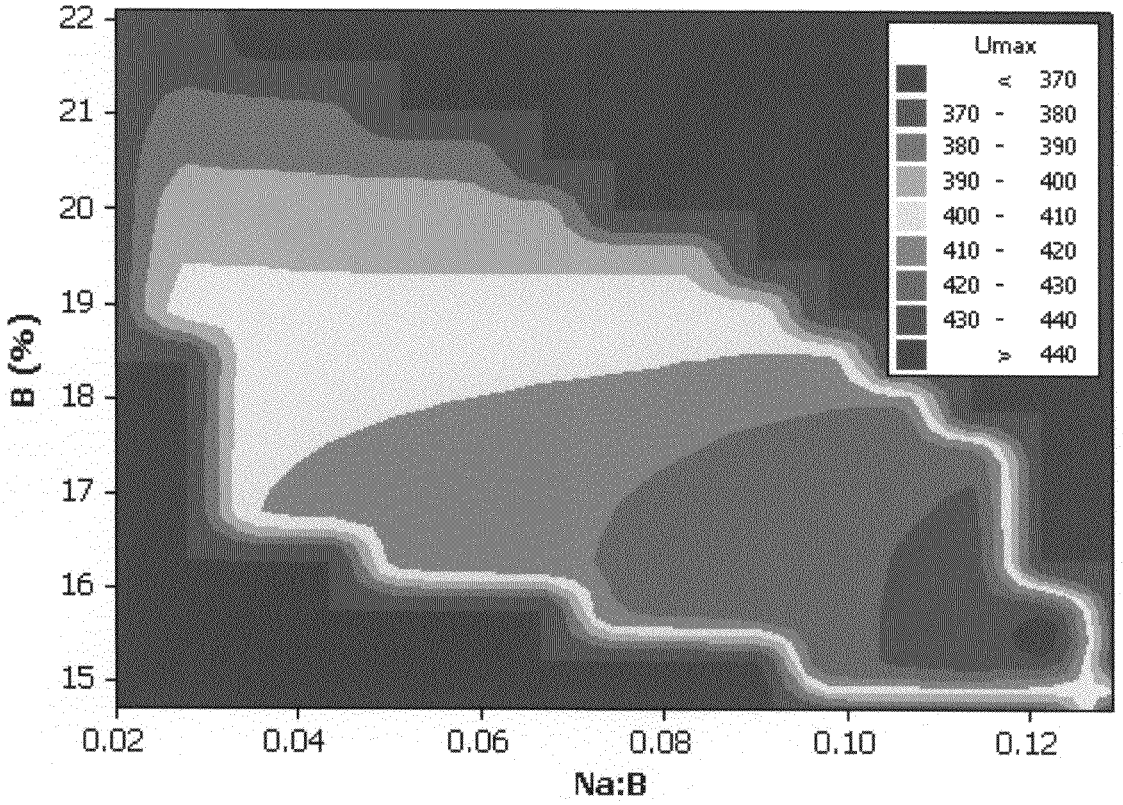
FIG. 6*b* illustrates the effect of boron glass network former amount (% B) and alkali element proportion (Na:B) on the maximum permeability of a product according to the present invention.

In FIG. 6 are plotted the effect of the surface composition of the coated powders on the resistivity and maximum permeability of SMC bars and rings heat-treated at 500° C./30 min in air (data from Table V and Table VII). As expected, the resistivity increases with an increase of the boron content (FIG. 6*a*) but, interestingly, with a decreasing content and narrowing window of Na. In contrast, the maximum permeability of the SMC material increases with a decrease of the boron content in the coating and an increasing content and narrowing window of Na (FIG. 6*b*).

These Figures also clearly show the range of properties achievable with the alkali borate coatings. For example, at a level of 19% boron and a proportion of sodium corresponding to a Na:B of 0.07, which seems to be an optimal compromise, the SMC material resistivity should be between 40 and 60 μohm*m and the maximum permeability between 400 and 410.

Figure 7:
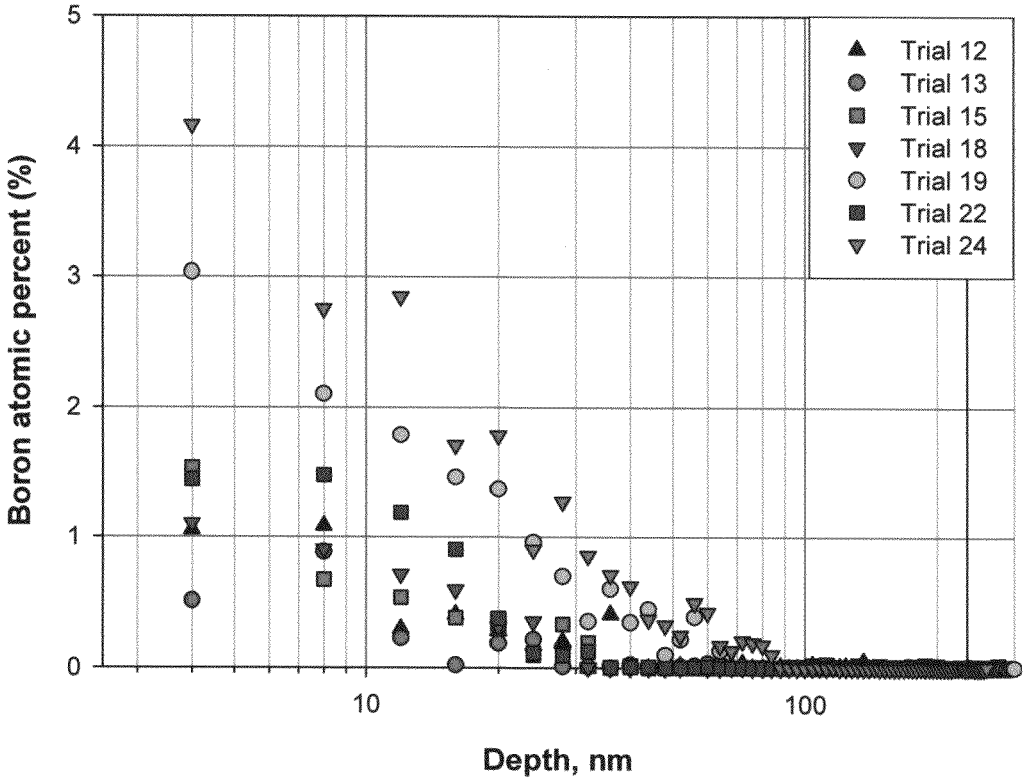
FIG. 7 illustrates the boron depth profile of coatings according to the present invention etched using an argon ion beam (XPS).

These variations in resistivity and permeability can be partly explained by the coating thickness deposited on the iron particles, as represented in FIG. 7. In fact, determining by XPS the elemental depth profile of boron through repetitive argon ion etching, it can be observed that the coating thickness globally increases with the increasing amount of dielectric used. These thicknesses, which vary between 30 nm and 90 nm (from trial #13 to trial #24), give an idea of the potential minimum air gap between the iron particles. As mentioned previously, this air gap strongly influences the final resistivity and permeability of the heat-treated SMC materials. The addition of sodium in the borate glass would decrease its viscosity thus allowing a more uniform and thin coating to be formed during the heat treatment. This closer arrangement of the iron particles would maximize the material permeability but decrease the resistivity simultaneously.

EXAMPLE 4

Range of Properties of SMC Materials

To further illustrate the processability and the range of properties achievable with the SMC material developed, a 50 lb batch of coated iron powder was produced using a laboratory blender/dryer. A solution containing 255 ml of methanol, 45 ml of demineralized water, 1.8 g of sodium tetraborate ($Na_2B_4O_7$*$5H_2O$) and 19.2 g of boric acid ($H_3BO_3$) was prepared. The iron powder was homogenized, sprayed with this solution, blended for another 5 minutes and then dried under vacuum with the blender shell heated to 100° C. After drying, 0.45% Kenolube lubricant was added to the coated iron powder and homogenized for 20 minutes. TRS bars and rings were pressed at room temperature and 690 MPa (50 tsi) and heat-treated at four different temperatures: 350, 450, 500 and 525° C.

Figure 8:
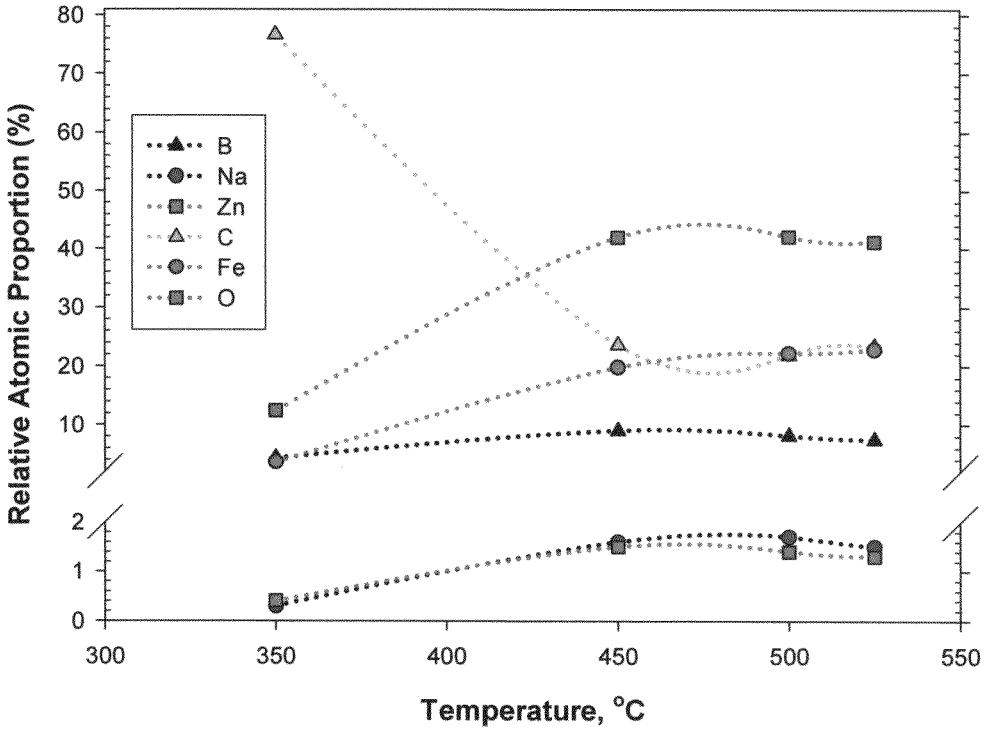
FIG. 8 illustrates the determination of coating chemical composition on ruptured TRS bars by XPS measurements with 30 min heat treatments at various temperatures.

The chemical composition of the glasses formed at these four heat treatment temperatures was determined using XPS analyses on ruptured TRS bars. FIG. 8 shows the evolution of the glass coating composition within the critical range of temperatures targeted by the present invention (from 350° C. to 525° C.).

Figure 9A:
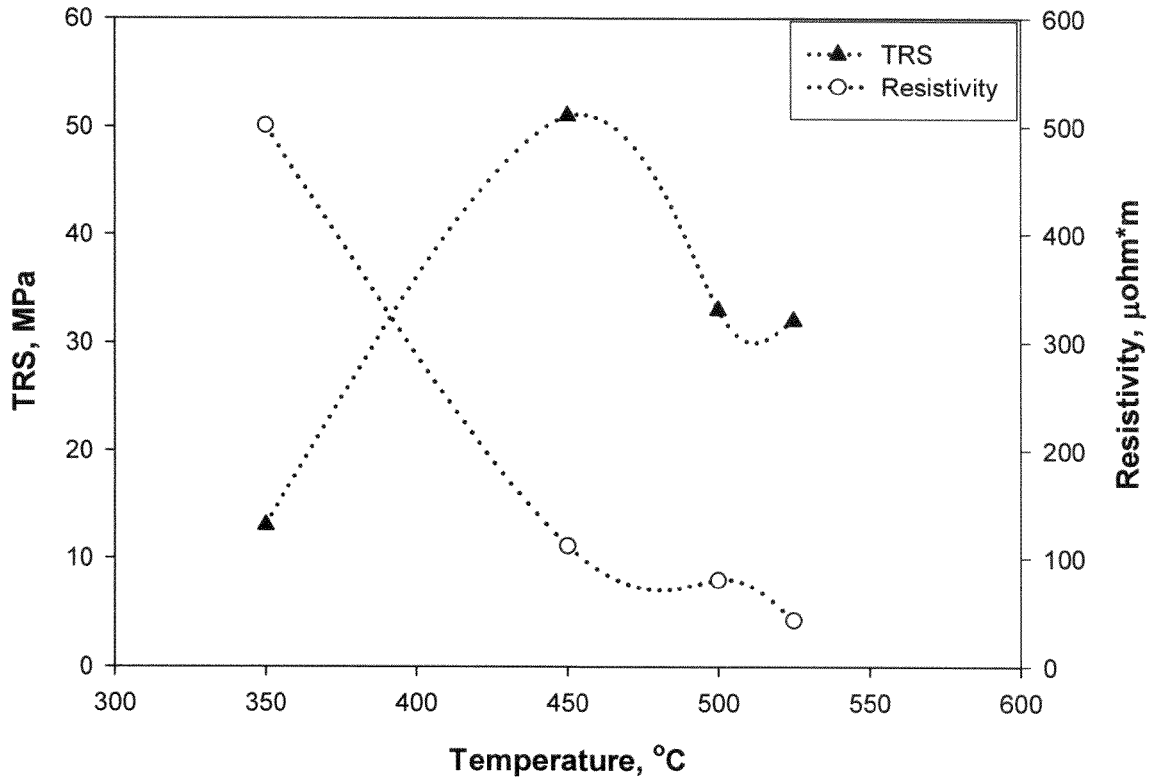
FIG. 9*a* illustrates TRS and resistivity of a product according to the present invention as a function of heat treatment temperature.

The composition of the coatings varies greatly for powders heat-treated at temperatures below 450° C. and stabilizes at temperatures between 450° C. and 525° C. In fact, at 350° C. the lubricant is not completely burned-out and 76% of carbon can be found on the particle surfaces. As the heat treatment temperature increases, the carbon level drops around 20% by an oxidation process which results in an increase of oxygen from 12% to 42% and an increase of iron from 3.6% to 22%. The boron level varies little over the entire heat treatment temperature range. The sodium (from the coating) and zinc (from the lubricant) contents increase up to temperatures of 450° C. where they then stabilize. Bridges of iron oxide ($Fe_2O_3$) are then formed between the iron particles resulting in a significant decrease of resistivity and an increase of mechanical strength, as shown in Table VIII and FIG. 9*a*. A maximum TRS of 50 MPa is achieved at 450° C.

Figure 9B:
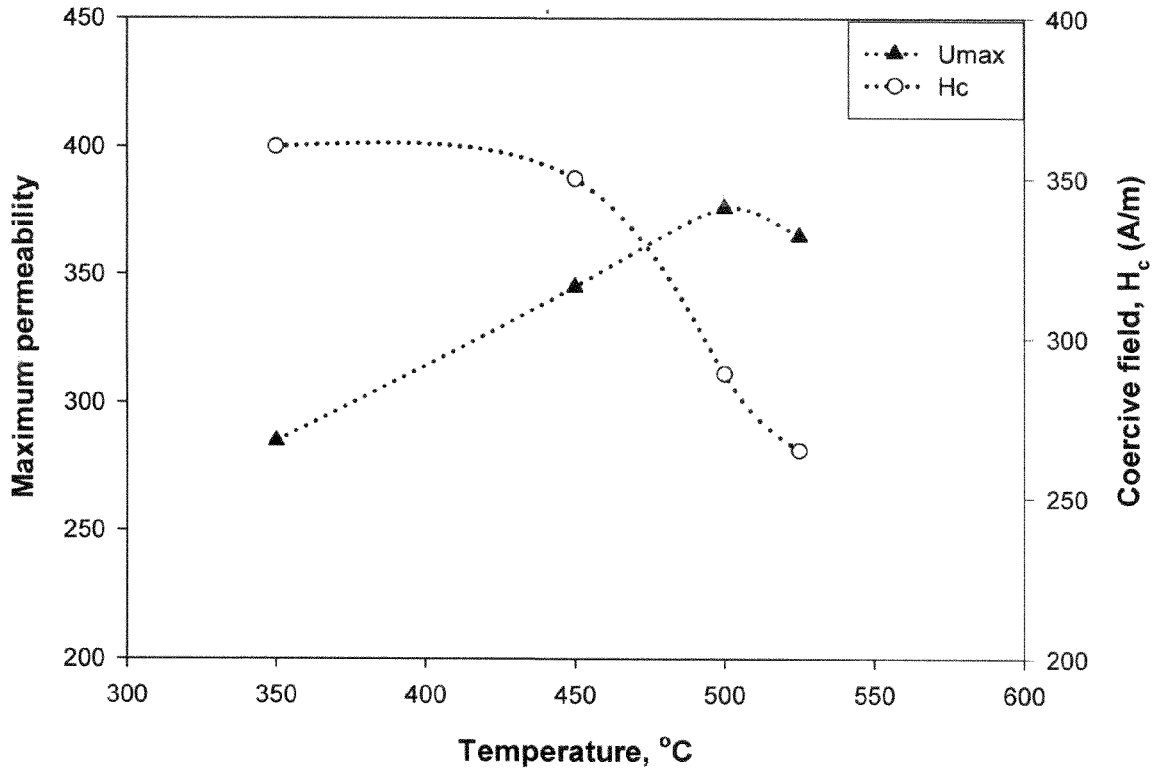
FIG. 9*b* illustrates maximum permeability and coercive field of a product according to the present invention as a function of heat treatment temperature.

Furthermore, the magnetic properties reported in Table VIII show that the formation of these bridges decreases the air gap between the iron particles, thus increasing the maximum permeability of the SMC materials, as shown in FIG. 9*b*. Also, at temperatures higher than 450° C., the extent of stress-relief in the material improves and the coercive field drops significantly.

TABLE VIII

Summary of the Physical Properties in Function of the Heat Treatment Temperature.

| Trial | Curing ° C. | Density g/cc | TRS MPa | Resis μohm * m | $B_{max}$ at 12 kA/m T | μmax | $H_c$ A/m | Core loss at 1 T (W/kg) 60 Hz | 200 Hz | 400 Hz | 600 Hz | 800 Hz | 1000 Hz |
|---|---|---|---|---|---|---|---|---|---|---|---|---|---|
| 31 | 350 | 7.15 | 13 | 501 | 1.45 | 285 | 360 | 9.5 | 32.7 | 66.4 | 103 | 137 | 169 |
| 32 | 450 | 7.27 | 51 | 111 | 1.42 | 345 | 350 | 9.5 | 34.6 | 77.4 | 128 | 184 | 252 |
| 33 | 500 | 7.26 | 33 | 80 | 1.48 | 376 | 289 | 8.0 | 28.7 | 62.6 | 101 | 142 | 193 |
| 34 | 525 | 7.26 | 32 | 43 | 1.45 | 365 | 265 | 7.6 | 28.2 | 62.7 | 102 | 144 | 206 |

Figure 10:
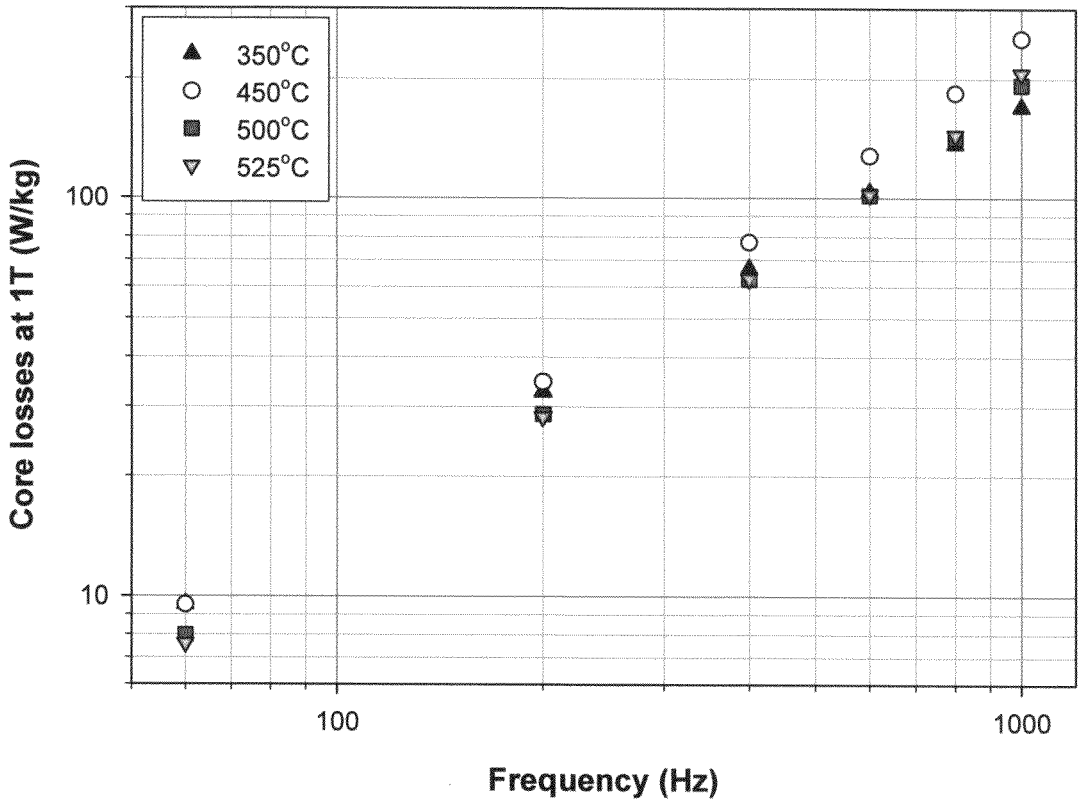
FIG. 10 illustrates core losses of a product according to the present invention at 1T as a function of the frequency of solicitation.

Core losses in function of the frequency of solicitation are plotted in FIG. 10. At low frequency, the coercive field of the SMC material principally determines core losses as hysteresis phenomena are dominating. As frequency increases, the resistivity becomes progressively more critical or important in order to minimize eddy currents. Thus SMC materials heat-treated at a higher temperature will have the lowest core losses at 60 Hz (lower coercive field) while at 1000 Hz the SMC material with the highest resistivity (350° C.) will have the lowest core losses.

Limitations

The last two examples illustrate how the coating composition and the heat treatment temperature can be adjusted in order to minimize core losses at the targeted application frequency and/or to maximize mechanical properties. However, since resistivity and maximum permeability are interconnected by an inverse relationship, not all desired combinations or properties are achievable. For example, when pressed at 690 MPa (25° C.) with 0.45% lubricant and heat treated at 500° C. for 30 minutes, a permeability of 450 with a resistivity of 100 μohm*m are not likely to be achieved (see FIG. 4). Also, since core losses at a certain frequency are influenced by the resistivity and the coercive field of the material, the heat treatment temperature can be adjusted to find a compromise. However, this adjustment, as shown in FIGS. 9 and 10, does not necessarily maximize permeability and mechanical strength (TRS) at the same time. In fact, these latter properties are limited to about 450 and 60 MPa respectively.

New Features and Main Advantages

Contrary to most of the patented insulated ferromagnetic powders, the insulated iron powders of the present invention contain a borate-based coating layer and not a phosphate-based coating layer such as those described in patent WO 97/30810 (Höganas) and U.S. Pat. No. 6,344,273. The insulating oxide layer of the present invention does not contain any phosphorous element other than the one already present in the base powder. When present as a minor constituent, as in Example 2 where $NaH_2PO_4$ is used as the alkali additive, the P content is lower than 50 ppm which is below the values covered by patent WO 97/30810.

In the present invention, alkali additives are also used as network modifiers to improve the insulation properties of the borate-based coatings. This is different from U.S. Pat. No. 6,344,273 in which Mg, Sn, Mn, Cd, and Ca are also used as network modifiers but in phosphate-based coatings. It is also different from U.S. Pat. No. 7,029,769 in which the glassy insulation film includes network former elements such as B, P, O and Fe and a second element that generates cations which are bivalent or more. In the present invention, it has been found that monovalent alkali elements such as Na and K increase the resistivity of the borate-glass coating principally constituted of carbon, boron, oxygen and iron. As shown in FIG. 10, the resistivity achieved with such coated powders after heat treatment at 500° C. is adequate or high enough for low and medium frequency applications (below 1,000 Hz).

In the present invention, the total amount of dielectric in the coating layer is less than 0.2 wt % with respect to the weight of iron powder. Such a thin insulation layer on the surface of the iron particles (below 100 nm) is required in order to maximize the magnetic permeability while keeping an adequate electrical insulation. This insulation coating is thus much thinner than in U.S. Pat. No. 6,756,118 where the total proportion of dielectric relative to the weight of powder metal is between 0.2 wt % and 3 wt %. Coatings become even thicker in cases where polymers are added in the SMC materials to increase the mechanical strength or the resistivity, such as in U.S. Pat. No. 6,537,389 and WO 00/30835.

In the present invention, the addition of oxygen-containing chemicals, such as boric acid, alkali phosphate, borate, or silicate increases the amount of oxygen present in the insulated ferromagnetic powder. This is different than U.S. Pat. No. 6,348,265 where the oxygen content of the powder is at most 0.2% by weight.

While this invention has been described with specific reference to particular embodiments, these embodiments are for the purpose of illustration only and are not intended as a limitation upon the scope of the following claims.

What is claimed is:

1. An insulated ferromagnetic powder comprising:

an iron base powder; and a borate-based dielectric insulating layer comprising a boron-bearing compound and an alkali glass modifier, said alkali glass modifier comprising an alkali-bearing compound that is different than said boron-bearing compound, wherein said iron powder has iron particles between 5 μm and 750 μm in size and said dielectric insulating layer has a thickness of less than 100 nm as determined through depth profiling of the boron element using XPS measurements and the argon ion beam etching technique.

2. The insulated ferromagnetic powder of claim 1, wherein said dielectric insulating layer has a thickness of less than 50 nm as determined through depth profiling of the boron element using XPS measurements and the argon ion beam etching technique.

3. The insulated ferromagnetic powder of claim 1, wherein the alkali-bearing compound comprises lithium, sodium, or potassium.

4. The insulated ferromagnetic powder of claim 1, wherein said dielectric layer comprises oxygen, boron and iron as glass forming elements and the alkali glass-modifier of said dielectric layer comprises lithium, sodium or potassium.

5. The insulated ferromagnetic powder of claim 1, wherein said dielectric layer comprises glass-forming elements consisting essentially of oxygen, boron and iron and the alkali glass-modifier of said dielectric layer consists essentially of lithium, sodium or potassium.

6. The insulated ferromagnetic powder of claim 4 or 5, which has an oxygen content that is at most 0.3% by weight higher than the base iron powder.

7. The insulated ferromagnetic powder of claim 4 or 5, wherein the oxygen to boron ratio, as determined by XPS surface analysis, is between 0.5 and 10.

8. The insulated ferromagnetic powder of claim 4 or 5, wherein the oxygen to boron ratio, as determined by XPS surface analysis, is between 1 and 5.

9. The insulated ferromagnetic powder of claim 4 or 5, wherein the ratio of lithium, sodium, and potassium to boron, as determined by XPS surface analysis, is between 0.001 and 0.3.

10. The insulated ferromagnetic powder of claim 4 or 5, wherein the ratio of lithium, sodium, and potassium to boron, as determined by XPS surface analysis, is between 0.01 and 0.15.

11. An insulated ferromagnetic powder comprising:

an iron base powder; and a dielectric insulating layer comprising a boron-bearing compound and an alkali-bearing compound, wherein said alkali-bearing compound is different than said boron-bearing compound, said iron powder has iron particles between 5 μm and 750 μm in size, and said dielectric insulating layer has a thickness of less than 50 nm as determined through depth profiling of the boron element using XPS measurements and the argon ion beam etching technique.

12. The insulated ferromagnetic powder of claim 11, wherein the alkali-bearing compound comprises lithium, sodium, or potassium.

13. The insulated ferromagnetic powder of claim 11, wherein the dielectric insulating layer further comprises glass-forming elements and glass-modifier elements.

14. The insulated ferromagnetic powder of claim 13, wherein the glass-forming elements comprise oxygen, boron and iron and the alkali glass-modifier elements comprise lithium, sodium or potassium.

15. The insulated ferromagnetic powder of claim 13, wherein the glass-forming elements consist essentially of oxygen, boron and iron, and the glass-modifier elements consist essentially of lithium, sodium or potassium.

16. The insulated ferromagnetic powder of claim 14 or 15, which has an oxygen content that is at most 0.3% by weight higher than the base iron powder.

17. The insulated ferromagnetic powder of claim 14 or 15, wherein the oxygen to boron ratio, as determined by XPS surface analysis, is between 0.5 and 10.

18. The insulated ferromagnetic powder of claim 14 or 15, wherein the oxygen to boron ratio, as determined by XPS surface analysis, is between 1 and 5.

19. The insulated ferromagnetic powder of claim 14 or 15, wherein the ratio of lithium, sodium, and potassium to boron, as determined by XPS surface analysis, is between 0.001 and 0.3.

20. The insulated ferromagnetic powder of claim 14 or 15, wherein the ratio of lithium, sodium, and potassium to boron, as determined by XPS surface analysis, is between 0.01 and 0.15.

21. An insulated ferromagnetic powder, comprising:

an iron base powder bearing a dielectric insulating layer comprising a boron-bearing compound and an alkali-bearing glass modifier, wherein said alkali-bearing glass modifier is different than said boron-bearing compound, said dielectric insulating layer comprising about 15-22 atomic % boron, and said iron base powder comprises iron particles between 5 μm and 750 μm in size and said dielectric insulating layer has a thickness of less than 100 nm as determined through depth profiling of the boron element using XPS measurements and the argon ion beam etching technique.

22. The insulated ferromagnetic powder of claim 21, wherein said dielectric insulating layer has a thickness of less than 50 nm as determined through depth profiling of the boron element using XPS measurements and the argon ion beam etching technique.

23. The insulated ferromagnetic powder of claim 21, wherein the alkali-bearing compound comprises lithium, sodium, or potassium.

24. The insulated ferromagnetic powder of claim 21, wherein said dielectric layer comprises oxygen, boron and iron as glass forming elements and the alkali-bearing glass modifier comprises lithium, sodium or potassium.

25. The insulated ferromagnetic powder of claim 21, wherein said dielectric layer comprises glass-forming elements consisting essentially of oxygen, boron and iron and the alkali-bearing glass modifier consists essentially of lithium, sodium or potassium.

26. The insulated ferromagnetic powder of claim 24 or 25 which has an oxygen content that is at most 0.3% by weight higher than the base iron powder.

27. The insulated ferromagnetic powder of claim 24 or 25, wherein the oxygen to boron ratio, as determined by XPS surface analysis, is between 0.5 and 10.

28. The insulated ferromagnetic powder of claim 24 or 25, wherein the oxygen to boron ratio, as determined by XPS surface analysis, is between 1 and 5.

29. The insulated ferromagnetic powder of claim 24 or 25, wherein the ratio of lithium, sodium, and potassium to boron, as determined by XPS surface analysis, is between 0.001 and 0.3.

30. The insulated ferromagnetic powder of claim 24 or 25, wherein the ratio of lithium, sodium, and potassium to boron, as determined by XPS surface analysis, is between 0.01 and 0.15.

31. The insulated ferromagnetic powder of claim 21, wherein said boron-bearing compound comprises orthoboric acid, metaboric acid, tetraboric acid, ammonium tetraborate, ammonium pentaborate or ammonium peroxyborate.

32. The insulated ferromagnetic powder of claim 31, wherein said glass modifier comprises Li, Na, K, Rb, Cs or Fr.

33. The insulated ferromagnetic powder of claim 31, wherein said glass modifier comprises LiOH, NaOH or KOH.

34. The insulated ferromagnetic powder of claim 31, wherein said glass modifier comprises $Na_2Co_3$, $Na_2B_4O_7$, $NaH_2PO_4$ or $Na_2SiO_3$.

35. A method for making an insulated ferromagnetic powder, comprising:

wet-coating an iron base powder with a borate-based coating solution comprising a boron-bearing compound and an alkali-bearing glass modifier, wherein said boron-bearing compound is different from said alkali-bearing glass modifier, so as to create the insulated ferromagnetic powder according to claim 21; and drying said coated iron powder at a predetermined temperature to form said dielectric insulating layer.

36. The method of claim 35, wherein the coating solution further comprises a solvent which is essentially organic.

37. The method of claim 36, wherein the organic solvent is ethanol, methanol, acetone, isopropyl alcohol, or glycerol.

38. The method of claim 36, wherein the coating solution further comprises water.

39. The method of claim 38, wherein the proportion of water is less than 30% of the total coating solution volume.

40. The method of claim 35, wherein wet-coating comprises completely immersing said iron powder in said coating solution.

41. The method of claim 35, wherein wet-coating comprises spraying said iron powder with said coating solution.

42. The method of claim 41, wherein the coating solution has dissolved active elements in concentrations between 0.5% and 30% (m/v) and that the total quantity of solutions sprayed onto the iron particles is between 1 and 50 ml per kg of iron powder.

43. The method of claim 42, wherein the coating solution has dissolved active elements in concentrations between 1% and 10% (m/v) and that the total quantity of solutions sprayed onto the iron particles is between 1 and 50 ml per kg of iron powder.

44. The method of claim 41, wherein the coating solution has dissolved active elements in concentrations between 0.5% and 30% (m/v) and that the total quantity of solutions sprayed onto the iron particles is between 5 and 30 ml/kg.

45. The method of claim 44, wherein the coating solution has dissolved active elements in concentrations between 1% and 10% (m/v) and that the total quantity of solutions sprayed onto the iron particles is between 5 and 30 ml/kg.

46. A method for making a product, comprising:

selecting an insulated ferromagnetic powder of claim 21;

mixing said insulated ferromagnetic powder with a lubricant to create a mixture;

pressing said mixture in a rigid die at room temperature up to 125° C. and at a pressure between 200 MPa and 1500 MPa to create pressed parts;

heating said pressed parts at a temperature between 300° C. and 700° C. allowing formation of a glassy insulating layer comprising glass-network formers and glass-network modifiers.

47. The method of claim 46, wherein the lubricant comprises one or more synthetic waxes, amine-based waxes, metallic stearates, polymeric lubricants or fatty acids in proportions between 0.2% and 1%.

48. The method of claim 46, wherein the lubricant comprises one or more synthetic waxes, amine-based waxes, metallic stearates, polymeric lubricants or fatty acids in proportions between 0.3% and 0.7%.

49. The method of claim 46, wherein the glass-network formers comprise boron, oxygen and iron, and wherein the glass-network modifiers comprise lithium, sodium or potassium, and optionally un-burned residual elements from the lubricant.

50. The method of claim 46, wherein the glass-network formers consist essentially of boron, oxygen and iron, and wherein the glass-network modifiers consist essentially of lithium, sodium or potassium, and optionally un-burned residual elements from the lubricant.

51. The method as in one of claims 46-50, wherein the heating of said pressed parts is at a temperature between 350° C. and 550° C.

52. The method as in one of claims 46-50, wherein the pressure is between 400 MPa and 1000 MPa.

53. The method as in one of claims 46-50, wherein the pressure is between 600 MPa and 850 MPa.

* * * * *